United States Patent [19]

Nicodemus

[11] 4,121,425

[45] Oct. 24, 1978

[54] THERMODYNAMIC SYSTEM

[76] Inventor: Carl D. Nicodemus, 176 Meigs St., Rochester, N.Y. 14607

[21] Appl. No.: 789,070

[22] Filed: Apr. 20, 1977

Related U.S. Application Data

[63] Continuation-in-part of Ser. No. 695,450, Jun. 14, 1976, abandoned.

[51] Int. Cl.[2] ..... F01K 21/00; F01K 25/00

[52] U.S. Cl. ..... 60/670; 60/649; 60/688; 60/689

[58] Field of Search ..... 60/643, 645, 649, 651, 60/671, 673, 650, 682, 688, 689

[56] References Cited

U.S. PATENT DOCUMENTS

| | | | |
|---|---|---|---|
| 3,788,064 | 1/1974 | Hawkins | 60/671 |
| 3,861,151 | 1/1975 | Hosokawa | 60/649 X |
| 4,051,680 | 10/1977 | Hall | 60/670 X |

*Primary Examiner*—Allen M. Ostrager

*Attorney, Agent, or Firm*—Stonebraker, Shepard & Stephens

[57] ABSTRACT

A thermodynamic system heats a portion of a liquid from a reservoir to vaporize some of the liquid and use the vapor to power an injector. The injector pumps unvaporized liquid through a path leading from the reservoir and through a rotatably driven transducer that outputs energy from the system. Two immiscible liquids can be used so that a portion of one of the liquids is vaporized to power the injector, and the other liquid is pumped through the transducer. Also, a vortex tube is preferably arranged between the vaporizer and the injector for dividing the vaporized liquid into relatively hot and cold portions and feeding the hot portion to the injector to power the injector.

13 Claims, 3 Drawing Figures

THERMODYNAMIC SYSTEM

RELATED APPLICATIONS

This is a continuation-in-part of my copending U.S. application Ser. No. 695,450, filed June 14, 1976, entitled THERMODYNAMIC SYSTEM, and abandoned upon filing of this continuation-in-part application.

BACKGROUND OF THE INVENTION

Steam-powered injectors are generally known and used for pumping condensate or other liquids into a boiler for a steam engine or steam cycle system, but the transducer in such systems is powered by steam, and the injector is merely a convenient pump for delivering liquid to the boiler. The invention involves recognition of a way that the pumping power of an injector can be used to pump liquid around a path leading through a rotatably driven transducer to extract energy from the moving liquid while using the steam merely to power the injector. This eliminates the need for a condenser and allows the entire system to be insulated and made more efficient than conventional steam cycle systems. The invention thus aims at improvements in simplicity, economy, and efficiency in a thermodynamic system.

SUMMARY OF THE INVENTION

The inventive thermodynamic system includes a reservoir containing a liquid and means for heating a portion of the liquid to form vapor, which is used to power an injector. The injector pumps an unvaporized portion of the liquid around a path from the reservoir through a rotatably driven transducer and back to the reservoir for extracting energy from the system. Two immiscible liquids can be used in the reservoir so that a portion of one of the liquids is vaporized and the other liquid is pumped through the transducer. Also, a vortex tube is preferably arranged between the heating means and the injector for dividing the vaporized liquid into relatively hot and cold portions so that the hot portion can be used to power the injector.

DRAWINGS

FIGS. 1–3 are schematic views of three preferred embodiments of the inventive system.

DETAILED DESCRIPTION

Figure 1:
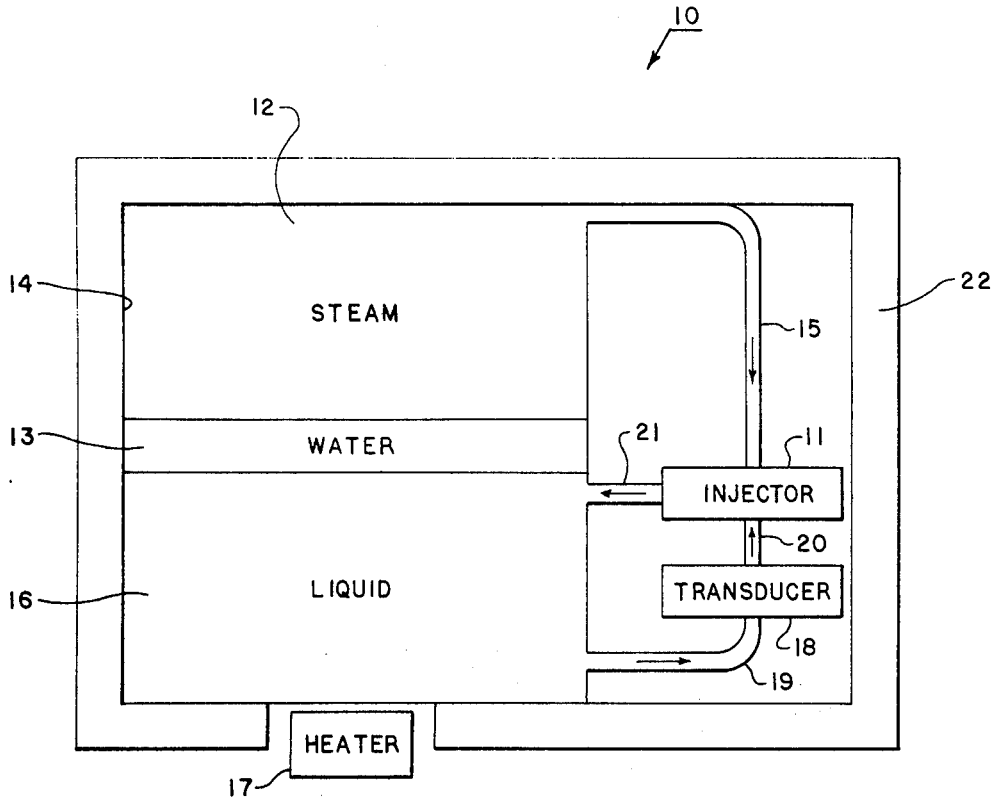

System 10 of FIG. 1 uses an injector 11 powered by steam 12 produced from water 13 in reservoir or boiler 14, and steam 12 passes through a line 15 leading to injector 11. Water 13 floats on top of a liquid 16 in boiler 14, and liquid 16 preferably has a higher specific gravity than water and a higher boiling point than water. Liquid 16 is preferably immiscible with water to remain in a lower portion of reservoir 14 under water 13. A heater 17 heats liquid 16, which in turn heats water 13 to produce steam 12 for powering injector 11.

Liquid 16 is pumped by injector 11 around a path that leads through transducer 18 that includes a rotatably driven element turned by the movement of liquid 16. The liquid flow path includes a line 19 leading out of boiler 14, a liquid passageway through transducer 18 for turning a rotatable element to extract energy from system 10, a line 20 leading from transducer 18 to injector 11, and a return line 21 conducting liquid 16 and steam or water from injector 11 back to boiler 14. The entire system is preferably enclosed in insulation 22 to increase the thermal efficiency.

Liquid 16 is preferably a type of oil or other liquid that is immiscible with water and also preferably has both a higher specific gravity and a higher boiling point than water. One possibility for liquid 16 is orthodichlorobenzene, but other liquids 16 are possible. The boiling point for liquid 16 is preferably substantially above the boiling point of water, such as 200° C or more, and the relatively high specific gravity for liquid 16 insures that water 13 floats on top of liquid 16.

Heat can be applied to boiler 14 in any of a variety of ways to produce the desired amount of steam 12 from water 13 for powering injector 11. Suitable valves, regulators, and controls can also be used in system 10, as is generally known in the art.

Transducer 18 can have several generally known forms, all preferably including a rotatable element configured to be driven by moving liquid. Transducer 18 then turns a shaft that can be used to extract energy from the system, by driving a load directly with the shaft, or by turning an electric generator to produce an electric potential that powers a load.

Steam 10 does not require a condenser such as ordinarily used in a steam cycle, because injector 11 can be powered by steam 12 without using a separate condenser, and injector 11 thereby serves as a pump for driving liquid 16 through transducer 18. This means that relatively little heat from heater 17 can keep system 10 operating, because heat does not have to be extracted from the system via a condenser, and the thermal energy input to the system can be more efficiently extracted via transducer 18.

Figure 2:
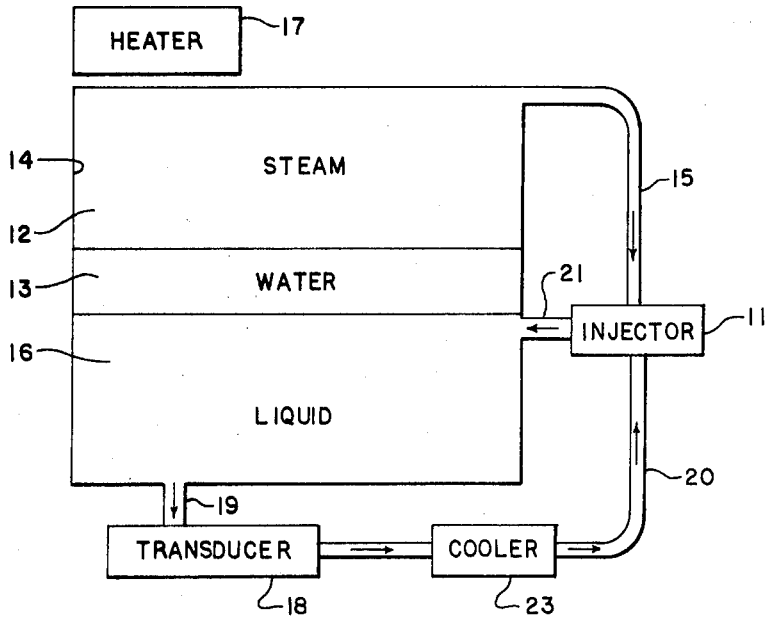

FIG. 2 shows another form of the inventive system, similar to the system of FIG. 1, except for changes in the location of components and the addition of a cooler 23 in line 20 between transducer 18 and injector 11. Heater 17 heats the upper part of boiler 14 to produce steam 12 from the water 13 above liquid 16 as previously described. Heater 17 can be in various forms, including a solar heater, and can use heat directly from the sun if the system is arranged on an orbiting satellite and properly oriented.

Cooler 23 allows a greater flow rate from the pumping force of injector 11 by keeping liquid 16 cool enough to insure condensation of steam 12 in injector 11 and increase the efficiency of injector 11. Cooler 17 can be arranged in a shaded portion of a properly oriented, orbiting satellite, or can be cooled by air or water in various ways that are generally known. The system of FIG. 2 can also be insulated if desired, with heater 17 and cooler 23 thermally separated. Also, transducer 18 can be arranged downstream from injector 11 in line 21, rather than upstream of injector 11 as shown.

The system of FIG. 2 offers the same economies available from the system of FIG. 1 in using the steam phase of the system for powering injector 11 to pump a liquid phase through a transducer 18 that extracts usable energy from the system. The inventive system can be used for a wide variety of power plant purposes and can be varied and augmented in many generally known ways, such as by the addition of valves and control systems, for example.

Figure 3:
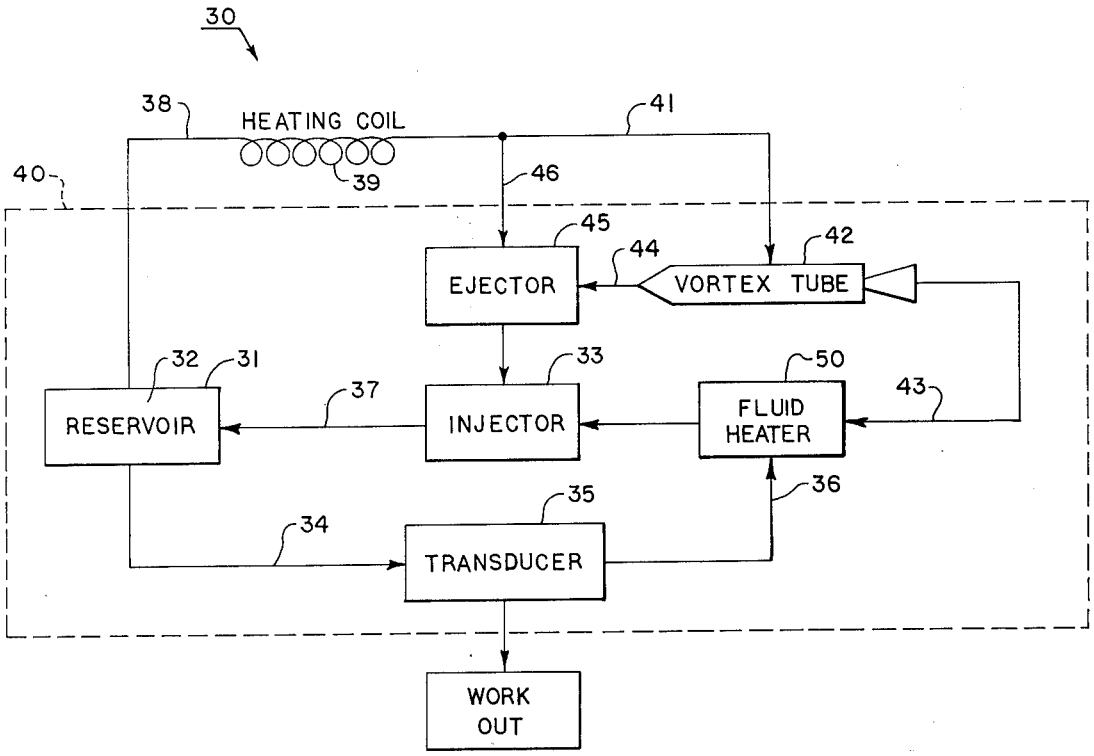

System 30 of FIG. 3 uses a reservoir 31 containing a single liquid 32, and an injector 33 pumps liquid 32 around a path that includes line 34 from reservoir 31, transducer 35 for extracting energy from the system, a line 36 leading to injector 33, and a line 37 leading back to reservoir 31. The liquid flow path from reservoir 31 through transducer 35 and injector 33 is thus similar to the liquid flow path described above, and the pumping force of injector 33 is used to maintain liquid flow and to extract energy from the system. The main differences from the systems of FIGS. 1 and 2 are use of a single liquid and a different way of powering injector 33.

In addition to standard injectors that are vapor powered for pumping a liquid, the term "injector" as used in this application is intended to encompass an analogous device closely similar to an injector, but sometimes called a fluid heater. It also combines a vapor and a liquid and acts as a pump, but it differs slightly from standard injectors in the way the output pressures and temperatures are related to the input pressures and temperatures. Injectors suitable for use with the invention cover either type of vapor-powered device for combining vapor with liquid to act as a pump without using mechanically moving parts.

Instead of heating liquid 32 in reservoir 31, liquid 32 is preferably conducted out of reservoir 31 via line 38 and is heated in a coil 39 or other heat exchanger to vaporize a portion of liquid 32. Heat from a variety of sources can be used for heating liquid 32 in heating means or vaporizer 39, and the vaporization of liquid 32 preferably occurs in a region that is thermally insulated from the rest of system 30. The preferred thermal insulation is schematically shown by broken line 40 enclosing all of the components of system 30, except heating means 39. This prevents heat and energy loss from the components of system 30, and allows liquid 32 to be a material that vaporizes at ambient terrestrial temperatures and pressures to allow use of many available heat sources.

The vapor output from vaporizer 39 passes through line 41 to a vortex tube 42 that effectively divides the vapor into relatively hot and cold portions, which is advantageous in providing a temperature differential for operating injector 33. The cold portion output from vortex tube 42 is fed into the liquid flow path via line 43, and can be introduced into the liquid flow path at several different points. A preferred arrangement is to use fluid heater 50 for combining the cold vapor output from vortex tube 42 with the liquid from transducer 35 in such a way that injector 33 pumps both the liquid and the vapor. The hot vapor output from vortex tube 42 is fed to injector 33 via line 44 for powering injector 33, and this can be done directly, rather than through ejector 45 as illustrated. The hot vapor output from vortex tube 42 is substantially hotter than the vapor output from heating element 39, and is thus more effective in operating injector 33.

The powering of injector 33 is even further improved by using ejector 45 powered by vapor from heating element 39 via line 46 to increase the pressure of the hot portion of the vapor from vortex tube 42 via line 44. Ejector 45 mixes the two vapors together and provides a hot vapor input to injector 33 at a higher pressure than is possible if ejector 45 is omitted and hot vapor output from vortex tube 42 is fed directly to injector 33. A fluid heater can also be used in place of ejector 45.

The working combination of vortex tube 42 and injector 33 is effective in keeping system 30 running, especially when heat losses are minimized by insulation 40. Injector 33 operates reliably when a sufficient temperature differential exists between the vapor and liquid inputs, and vortex tube 42 is reliable in combination with heating means 39 in establishing such a temperature differential. Like the other embodiments of the invention, a condenser and the enormous energy losses it entails are avoided for substantially increasing system efficiency. Operation on a single liquid also simplifies system 30 and allows use of liquids having boiling points substantially below 0° C so that heat sources for vaporizer 39 are widely available.

I claim:

1. A thermodynamic system comprising:

a. a reservoir;

b. a liquid in said reservoir;

c. means for heating a portion of said liquid to vaporize said heated portion of said liquid;

d. an injector;

e. means forming a vapor path for guiding said vaporized liquid from the region of said heating means, through said injector to power said injector, and back to said reservoir;

f. a rotatably driven transducer; and g. means for forming a liquid path powered by said injector for pumping an unvaporized portion of said liquid from said reservoir through said transducer and back to said reservoir.

2. A thermodynamic system comprising:

a. a reservoir;

b. two immiscible liquids in said reservoir;

c. heating means for vaporizing a portion of one of said liquids;

d. an injector;

e. means forming a vapor path for guiding said vaporized liquid from the region of said heating means, through said injector to power said injector, and back to said reservoir;

f. a rotatably driven transducer;

g. means for forming a liquid path powered by said injector for pumping an unvaporized portion of one of said liquids from said reservoir through said transducer and back to said reservoir; and h. said heating means is arranged for vaporizing a portion of one of said liquids and said liquid path means is arranged so said injector pumps the other of said liquids.

3. The system of claim 2 wherein said one liquid is water.

4. The system of claim 3 wherein said other liquid has a higher specific gravity than water and a higher boiling point than water.

5. The system of claim 4 wherein said other liquid is orthodichlorobenzene.

6. The system of claim 2 including cooling means in said liquid path between said transducer and said injector.

7. The system of claim 2 including thermal insulation enclosing said reservoir, injector, and transducer.

8. The system of claim 1 including a vortex tube arranged between said heating means and said injector for dividing said vaporized liquid into relatively hot and cold portions, and means for feeding said hot portion to said injector to power said injector.

9. The system of claim 8 including means for feeding said cold portion into said liquid path.

10. The system of claim 8 including thermal insulation enclosing said reservoir, injector, and transducer.

11. The system of claim 8 including an ejector powered by said vaporized liquid and arranged between said vortex tube and said injector for increasing the pressure of said hot portion.

12. The system of claim 11 including means for feeding said cold portion into a liquid path.

13. The system of claim 12 including thermal insulation enclosing said reservoir, injector, and transducer.

* * * * *